US009714552B2

(12) United States Patent
Ross et al.

(10) Patent No.: US 9,714,552 B2
(45) **Date of Patent: *Jul. 25, 2017**

(54) WELL COMPRISING A SAFETY MECHANISM AND SENSORS

(71) Applicant: Metrol Technology Limited, Aberdeen, Aberdeenshire (GB)

(72) Inventors: Shaun Compton Ross, Aberdeenshire (GB); Leslie David Jarvis, Aberdeenshire (GB)

(73) Assignee: Metrol Technology Limited, Aberdeen (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/712,022

(22) Filed: May 14, 2015

(65) Prior Publication Data

US 2015/0240592 A1 Aug. 27, 2015

Related U.S. Application Data

(62) Division of application No. 13/811,151, filed as application No. PCT/GB2011/051377 on Jul. 20, 2011.

(30) Foreign Application Priority Data

Jul. 20, 2010 (GB) ..... 1012175.4

(51) Int. Cl.
*E21B 34/00* (2006.01)
*E21B 34/06* (2006.01)
(Continued)

(52) U.S. Cl.
CPC ..... *E21B 33/127* (2013.01); *E21B 23/00* (2013.01); *E21B 23/06* (2013.01); *E21B 34/00* (2013.01);
(Continued)

(58) Field of Classification Search
CPC ..... E21B 23/00; E21B 33/12; E21B 34/00; E21B 34/066; E21B 2034/007; E21B 47/122; E21B 47/14
(Continued)

(56) References Cited

U.S. PATENT DOCUMENTS 3,272,517 A 9/1966 Howard
3,967,201 A 6/1976 Rorden
(Continued)

FOREIGN PATENT DOCUMENTS

CN 101595274 12/2009
EP 0932054 7/1999
(Continued)

OTHER PUBLICATIONS

PCT International Search Report dated Jun. 26, 2012; International Application No. PCT/GB2011/051377, International Filing Date: Jul. 20, 2011.
(Continued)

*Primary Examiner* — Matthew R Buck
(74) *Attorney, Agent, or Firm* — Hogan Lovells US LLP

(57) ABSTRACT

A well comprising: (a) a safety mechanism, the safety mechanism comprising: (i) an obstructing member moveable between a first position where fluid flow is permitted, and a second position where fluid flow is restricted;
(ii) a movement mechanism; (iii) and a wireless receiver, adapted to receive a wireless signal; wherein the movement mechanism is operable to move the obstructing member from one of the first and second positions to the other of the first and second positions in response to a change in the signal being received by the wireless receiver; (b) sensors to detect a parameter in the well, in the vicinity of the safety mechanism; wherein a sensor is provided above and a sensor is provided below the safety
(Continued)

mechanism. Embodiments of the invention have acoustic and/or electromagnetic receivers or transceivers.

47 Claims, 3 Drawing Sheets

(51) Int. Cl.

| | |
|---|---|
| ***E21B 47/12*** | (2012.01) |
| ***E21B 33/127*** | (2006.01) |
| ***E21B 23/00*** | (2006.01) |
| ***E21B 47/14*** | (2006.01) |
| ***E21B 34/16*** | (2006.01) |
| ***E21B 47/06*** | (2012.01) |
| ***E21B 34/12*** | (2006.01) |
| ***E21B 23/06*** | (2006.01) |

(52) U.S. Cl.
CPC ..... *E21B 34/066* (2013.01); *E21B 34/12* (2013.01); *E21B 34/16* (2013.01); *E21B 47/06* (2013.01); *E21B 47/122* (2013.01); *E21B 47/14* (2013.01)

(58) Field of Classification Search
USPC ... 166/363, 336, 364, 250.01, 65.1, 66, 113; 175/57
See application file for complete search history.

(56) References Cited

U.S. PATENT DOCUMENTS 4,147,222 A 4/1979 Patten et al.
4,213,480 A * 7/1980 Orum ..... F16K 31/143 137/556
4,367,794 A * 1/1983 Bednar et al. ..... 166/66.5
5,293,937 A * 3/1994 Schultz et al. ..... 166/250.01
5,394,141 A 2/1995 Soulier
5,555,945 A * 9/1996 Schultz ..... E21B 33/1243 166/250.07
5,576,703 A 11/1996 MacLeod et al.
5,960,883 A * 10/1999 Tubel ..... E21B 34/066 166/313
6,018,501 A * 1/2000 Smith ..... E21B 47/0001 367/134
6,144,316 A 11/2000 Skinner
6,176,312 B1 1/2001 Tubel et al.
6,177,882 B1 1/2001 Ringgenberg et al.
6,199,629 B1 * 3/2001 Shirk ..... E21B 34/06 166/302
6,236,620 B1 * 5/2001 Schultz ..... E21B 33/1272 175/48
6,513,596 B2 2/2003 Wester
6,547,011 B2 * 4/2003 Kilgore ..... 166/387
6,619,388 B2 * 9/2003 Dietz et al. ..... 166/66.7
7,093,674 B2 * 8/2006 Paluch ..... E21B 7/068 166/250.17
7,096,976 B2 * 8/2006 Paluch ..... E21B 21/10 166/250.17
7,261,162 B2 * 8/2007 Deans et al. ..... 166/336
7,347,271 B2 3/2008 Ohmer et al.
7,460,438 B2 * 12/2008 Hudson ..... E21B 34/066 106/313
7,477,160 B2 1/2009 Lemenager et al.
7,789,156 B2 * 9/2010 Pia ..... E21B 34/102 166/323
7,921,916 B2 4/2011 Lovell et al.
7,931,090 B2 * 4/2011 Smedstad et al. ..... 166/366
7,984,765 B2 * 7/2011 Askeland ..... 166/339
8,179,279 B2 * 5/2012 Voss ..... 340/854.6
8,243,550 B2 8/2012 Jeffryes
2002/0154028 A1 * 10/2002 Beique et al. ..... 340/856.3
2002/0195247 A1 * 12/2002 Ciglenec et al. ..... 166/250.11
2003/0098799 A1 5/2003 Zimmerman
2003/0164240 A1 * 9/2003 Vinegar et al. ..... 166/372
2004/0173363 A1 * 9/2004 Navarro-Sorroche .. E21B 47/06 166/387
2004/0238178 A1 * 12/2004 Laureano ..... E21B 33/035 166/368
2004/0262008 A1 12/2004 Deans et al.
2005/0028980 A1 2/2005 Page et al.
2006/0033638 A1 * 2/2006 Hall et al. ..... 340/854.6
2006/0124310 A1 * 6/2006 Lopez de Cardenas et al. ..... 166/313
2006/0131030 A1 * 6/2006 Sheffield ..... 166/374
2007/0173957 A1 * 7/2007 Johansen et al. ..... 700/9
2008/0007421 A1 * 1/2008 Liu et al. ..... 340/853.3
2008/0023205 A1 1/2008 Craster et al.
2008/0029306 A1 * 2/2008 Krueger ..... E21B 21/103 175/210
2008/0130412 A1 * 6/2008 Fink ..... G01V 11/002 367/82
2008/0135291 A1 * 6/2008 Hall et al. ..... 175/25
2008/0314591 A1 * 12/2008 Hales ..... E21B 33/12 166/285
2009/0090501 A1 * 4/2009 Hansen et al. ..... 166/72
2009/0266555 A1 10/2009 May et al.
2010/0011853 A1 1/2010 Anthony et al.
2010/0025045 A1 * 2/2010 Lake et al. ..... 166/373
2010/0170673 A1 7/2010 Krueger et al.
2011/0114333 A1 * 5/2011 Fenton ..... 166/373
2011/0168403 A1 7/2011 Patel
2011/0253240 A1 * 10/2011 Otto et al. ..... 137/625.48
2015/0292280 A1 * 10/2015 Lewis ..... E21B 3/00 175/25

FOREIGN PATENT DOCUMENTS

GB 2434718 1/2007
RU 2031292 3/1995
WO 2004018833 3/2004
WO 2007093793 8/2007
WO WO 2007093793 A1 * 8/2007
WO 2009093912 7/2009
WO 2009/153551 12/2009
WO 2010079320 7/2010

OTHER PUBLICATIONS

PCT International Search Report dated Jun. 26, 2012; International Application No. PCT/GB2011/051378, International Filing Date: Jul. 20, 2011.
European Examination Report for Application No. 13185464.8, Aug. 20, 2015. (7 pages).
European Examination Report for Application No. 13185465.5, Aug. 25, 2015. (6 pages).
Third Office Action issued in corresponding Chinese Application No. 201180041713.7 dated May 27, 2016.
Office Action issued in corresponding Eurasian Application No. 201370022 dated Jun. 20, 2016.
Examination Report issued in corresponding European Application No. 13185464.8 dated Aug. 11, 2016.
Examination Report issued in corresponding European Application No. 13185465.5 dated May 11, 2016.
Third Office Action issued in corresponding Chinese Application No. 201180041083.3 dated Jun. 15, 2016.
Eurasian Office Action issued in corresponding Eurasian Application No. 201370022/31 dated Dec. 4, 2015.
Final Office Action issued in corresponding U.S. Appl. No. 14/712,007 dated Feb. 4, 2016.
Chinese Office Action issued in corresponding Chinese Patent Application No. 201180041713.7 issued Dec. 5, 2016.
Eurasian Office Action issued in corresponding Eurasian Application No. 201370022 mailed Jan. 13, 2017.
Australian Examination Report issued in corresponding Australian Application No. 2015205835 issued Nov. 16, 2016.
Eurasian Office Action issued in corresponding Eurasian Application No. 201591321 mailed Sep. 19, 2016.

(56) References Cited

OTHER PUBLICATIONS

Australian Examination Report issued in corresponding Australian Application No. 2015205836 dated Jan. 16, 2017.
Non-Final Office Action issued in corresponding U.S. Appl. No. 14/712,007 dated Sep. 2, 2016.
Non-Final Office Action issued in corresponding U.S. Appl. No. 13/811,151 dated Oct. 26, 2016.
Non-Final Office Action issued in corresponding U.S. Appl. No. 14/712,022 dated Aug. 29, 2016.

* cited by examiner

WELL COMPRISING A SAFETY MECHANISM AND SENSORS

RELATED APPLICATIONS

This application is a divisional of, claims the benefit of and priority to U.S. Non-Provisional application Ser. No. 13/811,151, titled, "A Safety Mechanism For A Well, A Well Comprising The Safety Mechanism, And Related Methods," filed Feb. 26, 2013, which is a National Stage Entry of PCT Application No. PCT/GB2011/051377, titled, "A Safety Mechanism For A Well, A Well Comprising The Safety Mechanism, And Related Methods," filed Jul. 20, 2011, which is a PCT Application of GB1012175.4, titled, "A Well comprising a Safety Mechanism and Sensors," filed Jul. 20, 2010 each of which is incorporated herein by reference in its entirety.

FIELD

This invention relates to a safety mechanism, such as a valve, sleeve, packer or plug, for a well; a well comprising the safety mechanism; and methods to improve the safety of wells; particularly but not exclusively subsea hydrocarbon wells.

BACKGROUND

In recent years, oil and gas has been recovered from subsea wells in very deep water, of the order of over 1 km. This poses many technical problems in drilling, securing, extracting and abandoning wells in such depths.

In the event of a failure in the integrity of the well, wellhead apparatus control systems are known to shut the well off to prevent dangerous blow-out, or significant hydrocarbon loss from the well. Blow-out-preventers (BOPS) are situated at the top of subsea wells, at the seabed, and can be activated from a control room to shut the well, or may be adapted to detect a blow-out and shut automatically. Should this fail, a remotely operated vehicle (ROV) can directly activate the BOP at the seabed to shut the well.

In a completed well, rather than a BOP, a "Christmas" tree is provided at the top of the well and a subsurface safety valve (SSV) is normally added, "downhole" in the well. The SSV is normally activated to close and shut the well if it loses communication with the controlling platform, rig or vessel.

Despite these known safety controls, accidents still occur and a recent example is the disastrous blow-out from such a subsea well in the Gulf of Mexico, causing a massive explosion resulting in loss of life, loss of the rig and a significant and sustained escape of oil into the Gulf of Mexico, threatening wildlife and marine industries.

Whilst the specific causes of the disaster are, at present, unclear, some aspects can be observed: an Emergency Dis-connect System (EDS) controlled from the rig failed to seal and disconnect the vessel from the well; a dead-man/AMF system at the seabed failed to seal the well; subsequent Remotely Operated Vehicle (ROV) intervention also failed to activate the safety mechanisms on the BOP. Clearly the conventional systems focused primarily on the blow-out-preventer did not activate at the time of the blow-out and also failed to stem the tide of oil into the sea after control communication was lost with the rig.

SUMMARY

Thus there is a need to improve the safety of oil wells especially those situated in deep water regions.

Given the difficulty in communicating and controlling downhole tools (that is tools in the well), especially where communications are severed, one might consider the provision of a further shut off mechanism with the BOP situated at the seabed. However the inventors of the present invention have noted that the addition of more equipment at this point will be extremely difficult because it will increase the size and height of the components placed at this point, which immediately prior to installation, will be difficult for rigs to accommodate. Moreover, whilst this would add a further protective measure, it is largely the same concept as the existing safety systems. Indeed, increasing the complexity of the control systems to support these additional features may potentially have a detrimental impact on reliability of the over-all system rather than increasing the level of safety provided.

In the case of adding a further conventional control mechanism for devices, such as a valve, or sensor downhole; the inventors of the present invention also note limitations since, in the event of a blow-out, the ability to function these devices may be lost due to the inability to fluctuate pressure to control pressure activated devices, or due to the loss of control lines.

Thus it is difficult for a skilled person to design a further safety system which can practically add to the safety systems already provided in oil wells.

An object of the present invention is to mitigate problems with the prior art, and preferably to improve the safety of wells.

According to a first aspect of the present invention there is provided a safety mechanism comprising:

an obstructing member moveable between, normally from, a first position where fluid flow is permitted, and, normally to, a second position where fluid flow is restricted;

a movement mechanism;

and a wireless receiver normally a transceiver, adapted to receive, and normally transmit, a wireless signal;

wherein the movement mechanism is operable to move the obstructing member from one of the first and second positions to the other of the first and second positions in response to a change in the signal being received by the wireless transceiver.

The obstructing member can in certain embodiments therefore start at either the first or second positions.

The transceiver, where it provided, is normally a single device with a receiver functionality and a transmitter functionality; but in principle a separate receiver and a separate transmitter device may be provided. These are nonetheless considered to be a transceiver as described herein when they are provided together at one location.

Relays and repeaters may be provided to facilitate transmission of the wireless signals from one location to another.

The invention also provides a well comprising at least one safety mechanism according to the first aspect of the invention.

Typically the well has a wellhead.

Thus the present invention provides a significant benefit in that it can move, normally shut, an obstructing member, such as a valve, packer, sleeve or plug in response to a wireless signal. Significantly this is independent of the provision of control lines, such as hydraulic or electric lines, between a well and a wellhead apparatus, for example the BOP. Thus in the event of a disastrous blowout or explosion, a wireless signal can be sent to the valve merely by contacting the wellhead apparatus typically at the top of the well with a wireless transmitter, which will send the appropriate signal. For certain embodiments the wireless transmitter may be mounted onto the wellhead apparatus. Indeed this can be achieved even if the wellhead apparatus has suffered extensive damage, and/or the hydraulic, electric and other control lines have been damaged and the conventional safety systems have lost all functionality, since the wireless signal requires no intact control lines in order to shut off the valve. Thus this removes the present dependence on a functioning BOP/wellhead apparatus to prevent the egress of oil, gas or other well fluids into the sea.

In certain embodiments the transmitter may be provided as part of a wellhead apparatus.

Wellhead apparatus as used herein includes but is not limited to a wellhead, tubing and/or casing hanger, a BOP, wireline/coiled tubing lubricator, guide base, well tree, tree frame, well cap, dust cap and/or well canopy.

Typically the wellhead provides a sealing interface at the top of the borehole. Typically any piece of equipment or apparatus at or up to 20-30 m above the wellhead can be considered for the present purposes as wellhead apparatus.

Said "change in the signal" can be a different signal received, or may be receiving the control signal where no control signal was previously received and may also be loss of a signal where one was previously received. Thus in the latter case the safety mechanism may be adapted to operate when wireless communication is lost which may occur as a consequence of an emergency situation, rather than necessarily requiring a control signal positively sent to operate the safety mechanism.

Indeed the invention more generally provides a transceiver configured to activate and send signals after an emergency situation has occurred as defined herein.

In preferred embodiments the transceiver is an acoustic transceiver and the control signal is an acoustic control signal. In alternative embodiments, the transceiver may be an electromagnetic transceiver, and the signal an electromagnetic signal. Combinations may be provided for example part of the distance may be traveled by an acoustic signal, part by an electromagnetic signal, part by an electric cable, and/or part from a fiber optic cable; all with transceivers as necessary.

The acoustic signals may be sent through elongate members or through well fluid, or a combination of both. To send acoustic signals through the fluid, a pressure pulser or mud pulser may be used.

Preferably the obstructing member moves from the first to the second position.

Preferably the safety mechanism incorporates a battery.

The safety mechanism is typically deployed subsea.

The transceiver comprises a transmitter and a receiver. The provision of a transmitter allows signals to be sent from the safety mechanism to a controller, such as acknowledgement of a control signal or confirmation of activation.

The safety mechanism may be provided on a drill string, completion string, casing string or any other elongate member or on a sub-assembly within a cased or uncased section of the well. The safety mechanism may be used in the same wells as a BOP or a wellhead, tree, or well-cap and may be provided in addition to a conventional subsurface safety valve.

Typically a plurality of safety mechanisms are provided.

The transceiver may be spaced apart from the movement mechanism and connected by conventional means such as hydraulic line or electric cable. This allows the wireless signal to be transmitted over a smaller distance. For example the wireless signal can be transmitted from the wellhead apparatus to a transceiver up to 100 m, sometimes less than 50 m, or less than 20 m below the top of the well which is connected though hydraulics or electric cabling to the obstructing member. This allows the safety mechanism in accordance with the present invention to operate even when the wellhead, wellhead apparatus or the top 100 m, 50 m or 20 m of the well is damaged and control lines therein broken. Thus the benefits of embodiments can be focused on a particular areas. Accordingly embodiments of the present invention can be combined with fluid and/or electric control systems.

Preferably a sensor is provided to detect a parameter in the well, preferably in the vicinity of the safety mechanism.

Thus such sensors can provide important information on the environment in all parts of the well especially around the safety mechanism and the data from the sensors may provide information to an operator of an emergency situation that may be occurring or about to occur and may need intervention to mitigate the emergency situation.

Preferably the information is retrieved wirelessly, although other means, such as data cables, may be used. Preferably therefore the safety mechanism comprises a wireless transmitter, and more preferably a wireless transceiver.

The sensors may sense any parameter and so be any type of sensor including but not necessarily limited to temperature, acceleration, vibration, torque, movement, motion, cement integrity, pressure, direction and inclination, load, various tubular/casing angles, corrosion and erosion, radiation, noise, magnetism, seismic movements, stresses and strains on tubular/casings including twisting, shearing, compressions, expansion, buckling and any form of deformation; chemical or radioactive tracer detection; fluid identification such as hydrate, wax and sand production; and fluid properties such as (but not limited to) flow, density, water cut, pH and viscosity. The sensors may be imaging, mapping and/or scanning devices such as, but not limited to, camera, video, infra-red, magnetic resonance, acoustic, ultra-sound, electrical, optical, impedance and capacitance. Furthermore the sensors may be adapted to induce the signal or parameter detected by the incorporation of suitable transmitters and mechanisms. The sensors may also sense the status of equipment within the well, for example valve position or motor rotation.

The wireless transceiver may be incorporated within the sensor, valve or safety mechanism or may be independent from it and connected thereto. The sensors may be incorporated directly in the equipment comprising the transmitters or may transfer data to said equipment using cables or short-range wireless (e.g. inductive) communication techniques. Short range is typically less than 5 m apart, often less than 3 m apart and indeed may be less than 1 m apart.

The sensors need to operate only in an emergency situation but can also provide details on different parameters at any time. The sensors can be useful for cement tests, testing pressures on either side of packers, sleeves, valves or obstructions and wellhead pressure tests and generally for well information and monitoring from any location in the well.

The wireless signals may be sent retroactively, that is after an emergency situation has occurred, for example after a blow out.

Typically the sensors can store data for later retrieval and are capable of transmitting it.

The safety mechanism may be adapted to move the obstructing member to/from the first position from/to the second position automatically in response to a parameter detected by the sensor. Thus at a certain "trip point" the safety mechanism can close the well, if for example, it detects a parameter indicative of unusual data or an emergency situation. Preferably the safety mechanism is adapted to function in such a manner in response to a plurality of different parameters all detecting unusual data, thus suggesting an emergency situation. The parameter may be any parameter detected by the sensor, such as pressure, temperature, flow, noise, or indeed the absence of flow or noise for example.

Such safety mechanisms are particularly useful during all phases when a BOP is in use and especially during non-drilling phases when a BOP is in use.

Preferably the trip point can be varied by sending instructions to a receiver coupled to (not necessarily physically connected thereto) or integral with, the sensors and/or safety mechanism. Such embodiments can be of great benefit to the operator, since the different operations downhole can naturally experience different parameters which may be safe in one phase but indicative of an emergency situation in another phase. Rather than setting the trip point at the maximum safety level for all phases, they can be changed by communications including wireless communication for the different phases. For example, during a drilling phase the vibration sensed would be expected to be relatively high compared to other phases. Sensing vibration to the same extent in other phases may be indicative of an emergency situation and the safety mechanism instructed to change their trip point after the drilling phase.

For certain embodiments, a sensor is provided above and below the safety mechanisms and can thus monitor differential parameters in these positions which can in turn elicit information on the safety of the well. In particular any pressure differential detected across an activated safety mechanism would be of particular use in assessing the safety of the well especially on occasions where a controlling surface vessel moves away for a period of time and then returns.

Sensors and/or transceivers may also be provided in casing annuli.

In use, an operator can react to any abnormal and potentially dangerous occurrence which the sensors detect. This can be a variety of different parameters including pressure, temperature and also others like stress and strain on pipes or any other parameters/sensors referred to herein but not limited to those.

Moreover with a plurality of sensors, the data may provide a profile of the parameters (for example, pressure/temperature) along the casing and so aid identification where the loss of integrity has occurred, e.g. whether the casing, casing cement, float collar or seal assembly have failed to isolate the reservoir or well. Such information can allow the operator to react in a quick, safe and efficient manner; alternatively the safety mechanism can be adapted to activate in response to certain detected parameters or combination of parameters, especially where two or three parameters are showing unusual values.

Such a system may be activated in response to an emergency situation.

Thus the invention provides a method of inhibiting fluid flow from a well in an emergency situation, the method comprising:

in the event of an emergency, sending a wireless signal into the well to a safety mechanism according to the first aspect of the invention.

Preferred and other optional features of the previous embodiment are preferred and optional features of the method according to the invention immediately above.

An emergency or emergency situation is where uncontrolled fluid flow occurs or is expected to occur, from a well; where an unintended explosion occurs or there is an unacceptable risk that it may occur, where significant structural damage of the well integrity is occurring or there is an unacceptable risk that it may occur, or where human life, or the environment is in danger, or there is an unacceptable risk that it may be in danger. These dangers and risks may be caused by a number of factors, such as the well conditions, as well as other factors, such as severe weather.

Thus normally an emergency situation is one where at least one of a BOP and subsurface safety valve would be attempted to be activated, especially before/during or after an uncontrolled event in a well.

Furthermore, normally an emergency situation according to the present invention is one defined as the least, more or most severe accordingly to the IADAC Deepwater Well Control Guidelines, Third Printing including Supplement 2000, section 4.1.2. Thus events which relate to kick control may be regarded as an emergency situation according to the present invention, and especially events relating to an underground blowout are regarded as an emergency situation according to the present invention, and even more especially events relating to a loss of control of the well at the sea floor (if a subsea well) or the surface is even more especially an emergency according to the present invention.

Methods in accordance with the present invention may also be conducted after said emergency and so may be performed in response thereto, acting retroactively.

The method may be provided during all stages of the drilling, cementing, development, completion, operation, suspension and abandonment of the well. Preferably the method is provided during a phase where a BOP is provided on the well.

Optionally the method is conducted during operations on the well when attempts have been made to activate the BOP.

During these phases, embodiments of the present invention are particularly useful because the provision of physical control lines during these phases would obstruct the many well operations occurring at this time; and indeed the accepted practice is to avoid as much as possible installing devices which require communication for this reason. Embodiments of the present invention go against this practice and overcome the disadvantages by providing wireless communications. Thus an advantage of embodiments of this invention is that they enable the use of a safety valve or barrier in situations where conventional safety valves or barriers could not, or would not, normally be deployed.

The safety mechanism may comprise a valve, preferably a ball or flapper valve, preferably the valve may incorporate a mechanical over-ride controlled, for example, by pressure, wireline, or coiled tubing or other intervention methods. The valve may incorporate a 'pump through' facility to permit flow in one direction.

The obstructing member of the safety mechanism may be a sleeve.

Optionally the safety mechanism may be actuated directly using a motor but alternatively or additionally may be adapted to actuate using stored pressure, or preferably using well pressure acting against an atmospheric chamber, optionally used in conjunction with a spring actuator.

The safety mechanism may incorporate components which are replaceable, or incorporate key parts, such as batteries, or valve bodies which are replaceable without removing the whole component from the well. This can be achieved using methods such as side-pockets or replaceable inserts, using conventional methods such as wireline or coiled-tubing.

In order to retrieve data from the sensors and/or actuate the safety mechanism, one option is to deploy a probe. A variety of means may be used to deploy the probe, such as an electric line, slick line wire, coiled tubing, pipe or any other elongate member. Such a probe could alternatively or additionally be adapted to send signals. Indeed such a probe may be deployed into a casing annulus if required.

In other embodiments, the wireless signal may be sent from a device provided at the wellhead apparatus or proximate thereto, that is normally within 300 m. In one embodiment wireless signals can be sent from a platform, optionally with wireless repeaters provided on risers and/or downhole. For other embodiments, the wireless signals can be sent from the seabed wellhead apparatus, after receiving sonar signals from the surface or from an ROV. In other embodiments, the wireless signals can be sent from the wellhead apparatus after receiving a satellite signals from another location. Furthermore if the wellhead is a seabed wellhead, the wireless signals can be then sent from the seabed wellhead apparatus, after receiving sonar signals, which had been triggered/activated after receiving a satellite signal from another location.

The surface or surface facility may be for example a nearby production facility standby or supply vessel or a buoy.

Thus the device comprises a wireless transmitter, or transceiver and preferably also comprises a sonar receiver, to receive signals from a surface facility and especially a sonar transceiver so that it can communicate two-way with the surface facility. For certain embodiments an electric line may be run into a well and the wireless transceiver attached towards one end of the line. In other embodiments the signal may be sent from an ROV via a hot-stab connection or via a sonar signal from the ROV.

Therefore the invention also provides a device, in use fitted or retro-fitted to a top of a well, comprising a wireless transmitter and a sonar receiver; especially for use in an emergency situation.

The device is relatively small, typically being less than 1 $m^3$, preferably less than 0.25 $m^3$, especially less than 0.10 $m^3$ and so can be easily landed on the wellhead apparatus. The resulting physical contact between the wellhead apparatus and the device provides a connection to the well for transmission of the wireless signal. In alternative embodiments the device is built into the wellhead apparatus, which is often at the seabed but may be on land for a land well.

Thus such devices also operate wirelessly and do not require physical communication between the wellhead apparatus and a controlling station, such as a vessel or rig.

Embodiments of the invention also include a satellite device comprising a sonar transceiver and a satellite communication device. Such embodiments can communicate with the well, such as with said device at the wellhead apparatus in accordance with a previous aspect of the invention, and relay signals onwards via satellite. The satellite device may be provided on a rig or vessel or a buoy.

Thus according to one aspect of the invention there is provided a well apparatus comprising a well and a satellite device comprising a satellite communication mechanism, and a sonar, the device configured to relay information received from the sonar by satellite.

Preferably the device is independent of the rig, for example it may be provided on a buoy. Thus in the event that the rig is lost, the buoy may relay a control signal from a satellite to the well to shut down the well.

In a further embodiment the device at the wellhead apparatus may be wired to a surface or remote facility. Preferably however, the device is provided with further wireless communication options for communication with the surface facility. Typically the device has batteries to permit operation in the event of damage to the cable.

The safety mechanism may comprise a subsurface safety valve, optionally of known type, along with a wireless transceiver.

In alternative embodiments, the safety mechanism comprises a packer and an expansion mechanism. The movement mechanism causes the expansion mechanism to activate which expands the packer and so moving the packer from said first position to said second position.

Thus according to a further aspect of the present invention there is provided a packer apparatus comprising a packer and an activation mechanism, the activation mechanism comprising an expansion mechanism for expanding the packer and a wireless transceiver adapted to receive a wireless control signal and control the activation mechanism.

The wireless signal is preferably an acoustic signal and may travel through elongate members and/or well fluid.

Alternatively the wireless signal may be an electromagnetic or any other wireless signal or any combination of that and acoustic.

References throughout to "expanding" and "expansion mechanisms" etc include expanding a packer by compression of an elastomeric element and/or inflating a packer and inflation mechanisms etc and/or explosive activation with explosive mechanisms, or actuation of a swell mechanism by exposure of a swellable element to an activating fluid, such as water or oil.

The packer apparatus may be provided downhole in any suitable location, such as on a drill string or production tubing and, surprisingly, in a casing annulus between two different casing strings, or between the casing and formation or on a sub-assembly within a cased or encased section of the well.

In use after deployment and wireless activation downhole according to the present invention, the packer may be provided in the expanded state to provide a further barrier against fluid movement therepast, especially those provided on an outer face of an elongate member in a well. Those between said casing and a drill string/production tubing, are preferably reactive to an emergency situation that is unexpanded.

Thus the invention also provides a well apparatus comprising:

a plurality of casing strings;

a packer apparatus provided on one of the casing strings;

the packer apparatus comprising a wireless transceiver, and adapted to expand in response to a change in a wireless signal in order to restrict flow of fluid through an annulus between said casing string and an adjacent elongate member.

As noted above, the packer may be provided in use in the expanded configuration and act as a permanent barrier to resists fluid flow or may be provided in the unexpanded configuration and activated as required, for example in response to an emergency situation. Moreover the packer may be adapted to move from an expanded configuration, corresponding to the second position of the safety mechanism where fluid flow is restricted (normally blocked) and retract to the first position where fluid flow is permitted.

The adjacent elongate member may be another of the casing strings or may be a drill pipe or may be production tubing.

The invention also provides a packer as described herein for use on a production string in an emergency situation.

For example in a gas lift operation the packer may be provided on the production tubing and activated only in the event of an emergency.

Typically the packer is provided as a permanent barrier when the adjacent member is another casing string, and in the unexpanded configuration when the elongate member is a drill pipe of production tubing that is they remain unexpanded until they expand in response to an emergency situation.

Whilst the packer of the packer apparatus may expand in an inward or outward direction, preferably it is adapted to expand in an inward direction.

The annulus may be a casing annulus.

Thus an advantage of such embodiments is that fluid flow through an annulus can be inhibited, preferably stopped, by provision of such a packer in an annulus. Normally fluid does not flow through the casing annulus of a well and so the skilled person would not consider placing a packer in this position. However the inventors of the present invention have realized that the casing annulus is a flow path through which well fluid may flow in the event of a well failure and blow out. Such an event may be due to failure of the formation, cement and/or seals provided with the casing system and wellhead.

Preferably a plurality of packer apparatus are provided. Different packer apparatus may be provided in the same or in different annuli.

Preferably the packer apparatus is/are provided proximate to the top of the well. In this way the packers can typically inhibit fluid flow above the fault or suspected fault, in the casing. Therefore the packer(s) may be provided within 100 m of the wellhead, more preferably within 50 m, especially within 20 m, and ideally within 10 m.

The packers provided in a casing annulus may be non-weight packers, that is they do not necessarily have engaging teeth for example the packers may be inflatable or swell types.

The casing packers may be installed above the cemented-in section of the casing and they thus typically provide an additional barrier to flow of fluids above that traditionally provided by a portion of the well being cased in.

In alternative embodiments the packers may be provided on an inner side of the casing adjacent to a cemented in portion of the casing, thus inhibiting a flow path at this point, whilst the cement inhibits the flow path on the outside portion of the casing.

The safety mechanism may be a packer-like element without a through bore and so in effect function as a well plug or bridge plug.

In certain embodiments, the packer may be provided on a drill string.

Thus the invention provides a method of drilling, comprising during a drilling phase providing a drill string comprising a packer apparatus as defined herein.

As drill strings typically rotate and move vertically in a well during a drilling phase, a skilled person would not be minded to provide a packer thereon since a packer resists movement. However the inventors of the present invention note that a packer provided thereof can be used in an emergency situation and so provides advantages.

Thus the packer may be provided on drill string, production string, production sub-assembly and may operate in cased or uncased sections of the well.

The safety mechanisms and packers described herein may also have additional means of operation such as hydraulic and/or electric lines.

Thus the present invention also provides a method of deploying a safety mechanism according to the present invention, monitoring the well using data received from sensors as described herein associated with the safety mechanism whilst abandoning the well and/or cementing the well and/or suspending the well.

Unless otherwise stated methods and mechanisms of various aspects of the present invention may be used in all phases including drilling, suspension, production/injection, completion and/or abandonment of well operations.

The wireless signal for all embodiments is preferably an acoustic signal although may be an electromagnetic or any other signal or combination of signals.

Preferably the acoustic communications include Frequency Shift Keying (FSK) and/or Phase Shift Keying (PSK) modulation methods, and/or more advanced derivatives of these methods, such as Quadrature Phase Shift Keying (QPSK) or Quadrature Amplitude Modulation (QAM), and preferably incorporating Spread Spectrum Techniques. Typically they are adapted to automatically tune acoustic signaling frequencies and methods to suit well conditions.

Embodiments of the present invention may be used for onshore wells as well as offshore wells.

An advantage of certain embodiments is that the acoustic signals can travel up and down different strings and can move from one string to another. Thus linear travel of the signal is not required. Direct route devices thus can be lost and a signal can still successfully be received indirectly. The signal can also be combined with other wired and wireless communication systems and signals and does not have to travel the whole distance acoustically.

Any aspect or embodiment of the present invention can be combined with any other aspect of embodiment mutatis mutandis.

BRIEF DESCRIPTION OF THE DRAWINGS

An embodiment of the present invention will now be described, by way of example only, and with reference to the accompanying figures in which.

DETAILED DESCRIPTION

Figure 1:
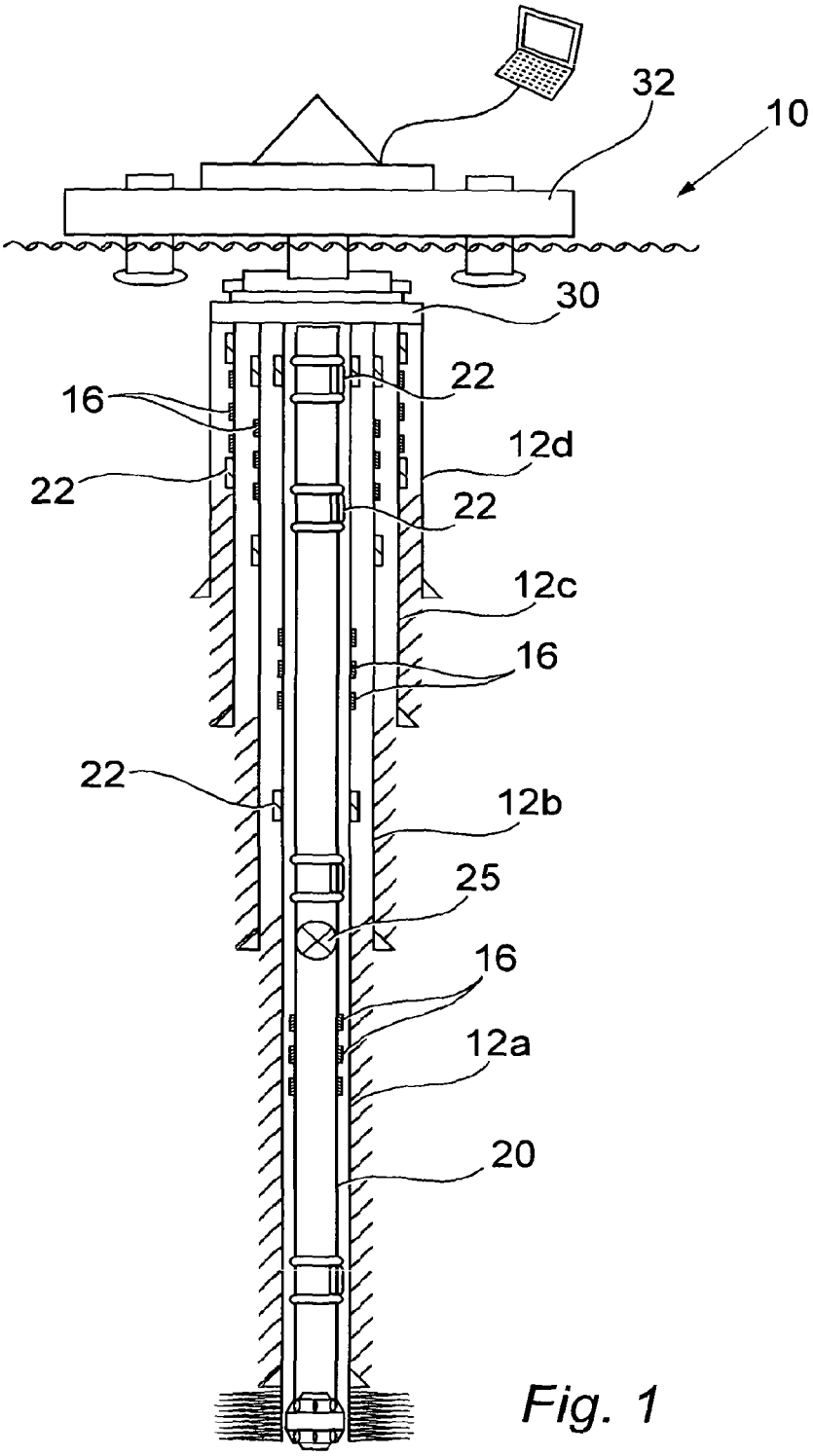
FIG. 1 is a diagrammatic sectional view of a well in accordance with one aspect of the present invention.

FIG. 1 shows a well 10 comprising a series of casing strings 12*a*, 12*b*, 12*c*, and 12*d* and adjacent annuli A, B, C, D between each casing string and the string inside thereof, with a drill string 20 provided inside the innermost casing 12*a*.

As is conventional in the art, each casing strings extends further into the well than the adjacent casing string on the outside thereof. Moreover, the lowermost portion of each casing string is cemented in place as it extends below the outer adjacent string.

In accordance with one aspect of the present invention, safety packers 16 are provided on the casing above the cemented as well as on the drill string 20.

These can be activated acoustically at any time including retroactively i.e. after the emergency, in order to block fluid flow through the respective annuli. Whilst normal operation will not require the activation of such packers, they will provide a barrier to uncontrolled hydrocarbon flow should the casing or other portion of the well control fail.

Moreover sensors (not shown), in accordance with one aspect of the present invention, are provided above and below said packers in order to monitor downhole parameters at this point. This can provide information to operators on any unusual parameters and the sealing integrity of the packer(s).

Acoustic relay stations 22 are provided on the drill pipe as well as various points in the annuli to relay acoustic data retrieved from sensors in the well.

A safety valve 25 is also provided in the drill string 20 and this can be activated acoustically in order to prevent fluid flow through the drill string.

In such an instance a device (not shown) comprising a sonar receiver and an acoustic transceiver installed or later landed at a wellhead apparatus such as a BOP structure 30 at the top of the well. The operator sends a sonar signal from a surface facility 32 which is converted to an acoustic signal and transmitted into the well by the device. The subsea valve 25 picks up the acoustic signal and shuts the well downhole (rather than at the surface), even if other communications are entirely severed with the BOP.

In alternative embodiments a packer picks up the signal rather than the safety valve 25. The packer can then shut a flowpath e.g. an annulus.

Thus embodiments of the present invention benefit in that they obviate the sole reliance on seabed/rig floor/bridge BOP control mechanisms. As can be observed by disastrous events in the Gulf of Mexico in 2010, the control of a well where the BOP has failed can be extremely difficult and ensuing environmental damage can occur given the uncontrolled leak of hydrocarbons in the environment. Embodiments of the present invention provide a system which reduce the risk of such disastrous events happening and also provide a secondary control mechanism for controlling subsurface safety mechanisms, such as subsurface valves, sleeves, plugs and/or packers.

For certain embodiments a control device is provided on a buoy or vessel separate from a rig. The device comprises sonar transmitter and a satellite receiver. The device can therefore receive a signal from a satellite directed from an inland installation, and communicate this to the well in order to shut down the well; all independent of the rig. In such embodiments, the well can be safely closed down even in the disastrous event of losing the rig.

Figure 4A:
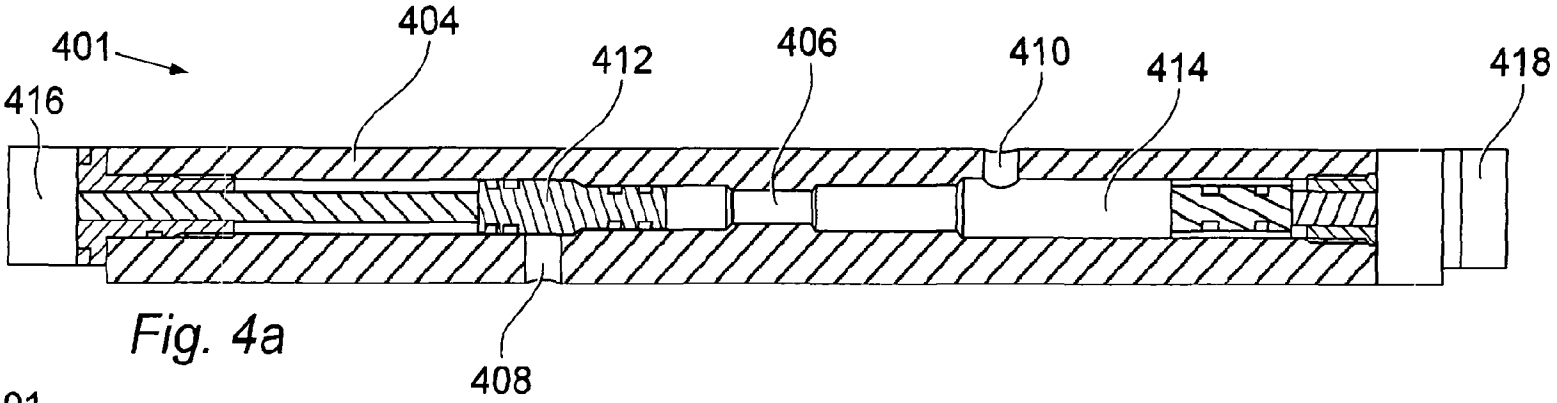
Figure 4B:
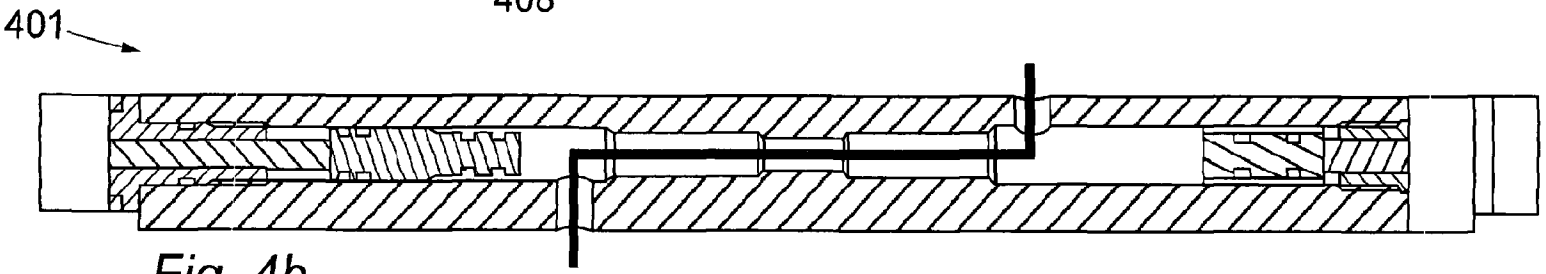
Figure 4C:
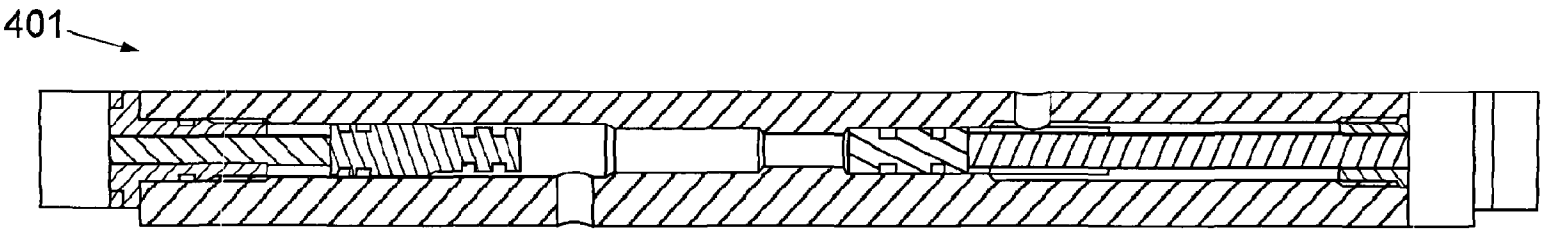

A casing valve sub 400 is shown FIGS. 4*a*-4*c* comprising an outer body 404 having a central bore 406 extending out of the body 404 at an inner side through port 408 and an outer side through port 410. A moveable member in the form of a piston 412 is provided in the bore 406 and can move to seal the port 408. Similarly a second moveable member in the form of a piston 414 is provided in the bore 406 and can move to seal the port 410. Actuators 416, 418 control the pistons 412, 414 respectively.

The casing valve sub 400 is run as part of an overall casing string, such as a casing string 12 shown in FIG. 1, and positioned such that the port 408 faces an inner annulus and the port 410 faces an outer annulus.

In use, the pistons 412, 414 can be moved to different positions, as shown in FIGS. 4*a*, 4*b* and 4*c*, by the actuators 416, 418 in response to wireless signals which have been received. Thus the pressure between the inner and outer annuli can be sealed from each other by providing at least one of the pistons 412, 414 over or between the respective ports, 408, 410 as shown in FIG. 4*a*, 4*c*.

In order to equalize the pressure between the inner and outer annuli, the pistons 412, 414 are moved to a position outside of the ports 408, 410 so they do not block them nor block the bore 406 therebetween, as shown in FIG. 4*b*. The pressures can thus be equalized.

Thus such embodiments can be useful in that they provide an opportunity to equalize pressure between two adjacent casing annuli if one exceeded a safe pressure and/or if an emergency situation had occurred.

The port can then be isolated and pressure monitored to see if pressure is going to build-up again. Thus, in contrast to for example a rupture disk, where it cannot return to its original position, embodiments of the present invention can equalize pressure between casing strings, be reset, and then repeat this procedure again, and for certain embodiments, repeat the procedure indefinitely.

In one scenario the pressure in a casing string may build up due to fluid flow and thermal expansion. A known rupture disk can resolve problems of excessive pressure, and the well can continue to function normally. However a further occurrence of such excess pressure cannot be dealt with. Moreover it is sometimes difficult to ascertain whether the excess pressure was caused by such a manageable event or whether it is indicative of a more serious problem especially if repeated occurrences of the excess pressure cannot be detected nor alleviated in known systems. Embodiments of the present invention mitigate these problems. For some embodiments, a number of different casing subs 401 may be used in one string of casing.

Figure 2:
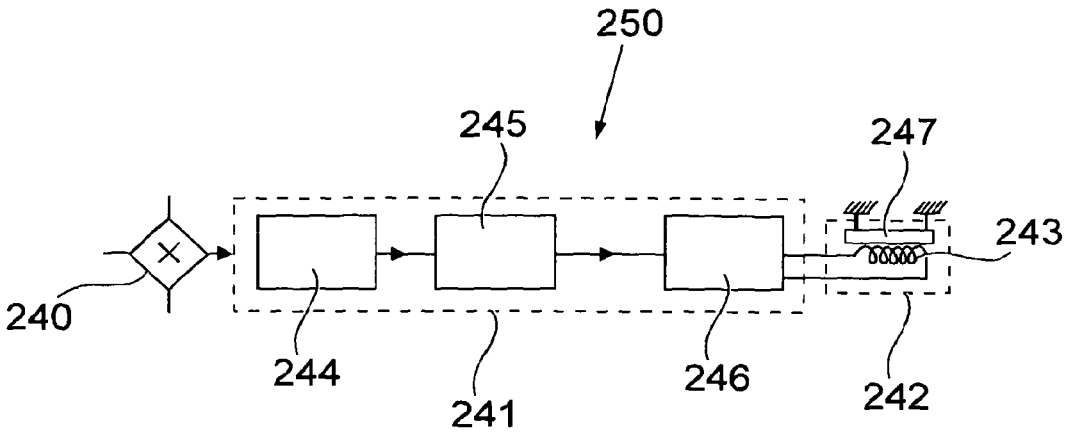
FIG. 2 is a schematic diagram of the electronics which may be used in a transmitting portion of a safety mechanism of the present invention.

FIG. 2 shows a transmitting portion 250 of the safety mechanism. The portion 250 comprises a transmitter (not shown) powered by a battery (not shown), a transducer 240 and a thermometer (not shown). An analogue pressure signal generated by the transducer 240 passes to an electronics module 241 in which it is digitized and serially encoded for transmission by a carrier frequency, suitably of 1 Hz-10 kHz, preferably 1 kHz-10 kHz, utilizing an FSK modulation technique. The resulting bursts of carrier are applied to a magnetostrictive transducer 242 comprising a coil formed around a core (not shown) whose ends are rigidly fixed to the well bore casing (not shown) at spaced apart locations. The digitally coded data is thus transformed into a longitudinal sonic wave.

The transmitter electronics module 241 in the present embodiment comprises a signal conditioning circuit 244, a digitizing and encoding circuit 245, and a current driver 246. The details of these circuits may be varied and other suitable circuitry may be used. The transducer is connected to the current driver 246 and formed round a core 247. Suitably, the core 247 is a laminated rod of nickel of about 25 mm diameter. The length of the rod is chosen to suit the desired sonic frequency.

Figure 3:
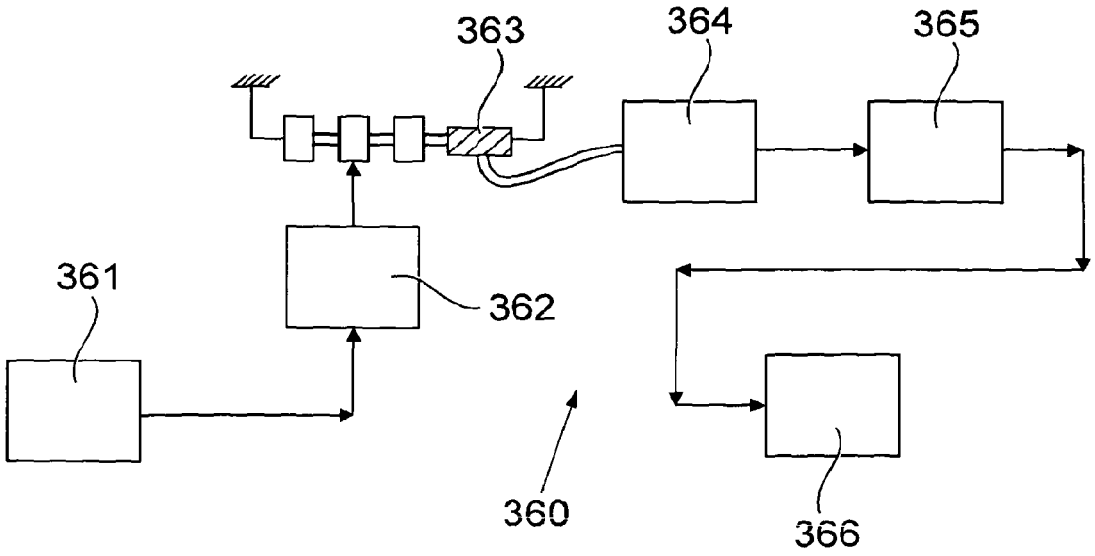
FIG. 3 is a schematic diagram of the electronics which may be used in a receiving portion of a safety mechanism of the present invention; and, FIGS. 4*a*-4*c* are sectional views of a casing valve sub in various positions.

FIG. 3 shows a receiving portion 360 of the safety mechanism. A receiving portion 361 comprises a filter 362 and a transducer 363 connected to an electronics module powered by a battery (not shown). The filter 362 is a mechanical band-pass filter tuned to the data carrier frequencies, and serves to remove some of the acoustic noise which could otherwise swamp the electronics. The transducer 363 is a piezoelectric element. The filter 362 and transducer 363 are mechanically coupled in series, and the combination is rigidly mounted at its ends to one of the elongated members, such as the tubing or casing strings (not shown). Thus, the transducer 363 provides an electrical output representative of the sonic data signal. Electronic filters 364 and 365 are also provided and the signal may be retransmitted or collated by any suitable means 366, typically of a similar configuration to that shown in FIG. 2.

An advantage of certain embodiments is that the acoustic signals can travel up and down different strings and can move from one string to another. Thus linear travel of the signal is not required. Direct route devices thus can be lost and a signal can still successfully be received indirectly. The signal can also be combined with other wires and wireless communication systems and does not have to travel the whole distance acoustically.

Improvements and modifications may be made without departing from the scope of the invention. Whilst the specific example relates to a subsea well, other embodiments may be used on platform or land based wells.

The invention claimed is:

1. A well comprising:

(a) a valve on a drill string, the drill string comprising a drill bit, and the valve comprising:

(i) an obstructing member moveable between a first position where fluid flow is permitted, and a second position where fluid flow is restricted through the drill string in order to shut the well downhole;

(ii) a movement mechanism;

(iii) and a wireless receiver, adapted to receive a wireless signal;

wherein the movement mechanism is operable to move the obstructing member from one of the first and second positions to the other of the first and second positions in response to a change in the signal being received by the wireless receiver;

(b) sensors to detect pressure in the well, in the vicinity of the valve; wherein a sensor is provided above and a sensor is provided below the valve to monitor differential pressure across the valve.

2. A well as claimed in claim 1, wherein the wireless receiver is one of:

(i) an acoustic receiver and the signal is an acoustic signal;

(ii) an electromagnetic receiver and the signal is an electromagnetic signal; and (iii) an electromagnetic receiver and an acoustic receiver and the signal is transmitted over part of its distance by the electromagnetic receiver and part of its distance by the acoustic receiver.

3. A well as claimed in claim 1, wherein the wireless receiver is a wireless transceiver.

4. A well as claimed in claim 1, further comprising a subsurface safety valve.

5. A well as claimed in claim 1, wherein the information provided by the sensors is retrieved wirelessly.

6. A well as claimed in claim 1, wherein the receiver is up to 100 m below the top of the well.

7. A well as claimed in claim 1, further comprising a device which is in use fitted or retro-fitted to a top of the well, comprising a wireless transmitter and a sonar receiver; for use in an emergency situation.

8. A well as claimed in claim 7, wherein the device is less than 1 $m^3$.

9. A well apparatus comprising a well as claimed in claim 1, and a sonar receiver and a sonar transmitter.

10. A well apparatus as claimed in claim 9, wherein a satellite device is provided, the device comprising a satellite communication mechanism and configured to relay information received between the sonar receiver and the sonar transmitter and the satellite.

11. A method of inhibiting fluid flow from a well as claimed in claim 1 or a well apparatus as claimed in claim 9 in an emergency situation, the method comprising: in the event of an emergency situation, sending a wireless signal into the well to the valve.

12. A method as claimed in claim 11, wherein the wireless signal is sent during a phase where a BOP is provided on the well.

13. A method as claimed in claim 11, wherein the wireless signal is sent from a device provided at a wellhead apparatus of the well or proximate thereto.

14. A method as claimed in claim 12, wherein the wireless signal is sent from a platform with wireless repeaters provided on risers and/or downhole.

15. A method as claimed in claim 11, wherein the wireless signal is sent from a seabed wellhead apparatus, after receiving sonar signals from a surface installation or an ROV.

16. A method as claimed in claim 11 wherein an ROV connects to a seabed wellhead apparatus and send or receives signals via a hot-stab connection.

17. A method as claimed in claim 11, wherein the wireless signal is sent from a wellhead apparatus after receiving satellite signals from another location.

18. A well as claimed in claim 1, wherein the valve comprises a battery.

19. A well as claimed in claim 2, wherein the wireless receiver is an acoustic receiver and the signal is an acoustic signal.

20. A method as claimed in claim 11, wherein the signals are sent retroactively, after an emergency situation has occurred.

21. A well as claimed in claim 1, wherein a BOP is provided on the well.

22. A well as claimed in claim 1, wherein the valve comprises a ball or flapper valve.

23. A well as claimed in claim 1, wherein the valve incorporates at least one of:

a mechanical over-ride; and a pump through facility to permit flow in one direction.

24. The well of claim 23, wherein the valve incorporates the mechanical over-ride and the mechanical over-ride is controlled by pressure, wireline, or coiled tubing.

25. The well of claim 24, wherein the mechanical over-ride is controlled by pressure.

26. The well of claim 1, wherein the valve is operable in response to a detected pressure.

27. The well of claim 1, wherein the valve is adapted to actuate using well pressure acting against an atmospheric chamber.

28. A method of deploying the valve according to claim 1, the method comprising monitoring the well using data received from the sensors.

29. The method of claim 28, comprising monitoring the well using data received from the sensors whilst abandoning the well and/or cementing the well and/or suspending the well.

30. The method of claim 28, method comprising monitoring the well during at least one of:

cement tests;

testing pressures on either side of packers, sleeves, valves or obstructions;

and wellhead pressure tests.

31. The method of claim 28, wherein the method comprises monitoring the well when a BOP is in use.

32. The method of claim 31, wherein the method comprises monitoring the well during non-drilling phases when the BOP is in use.

33. The method of claim 32, wherein the method comprises drilling.

34. The method of claim 28, wherein the method comprises inhibiting fluid flow from the well in an emergency situation.

35. A well comprising:

(a) a safety mechanism, the safety mechanism comprising:

(i) an obstructing member in the form of a packer moveable between a first position where fluid flow is permitted, and a second position where fluid flow is restricted in order to shut an annulus;

(ii) a movement mechanism;

(iii) and a wireless receiver, adapted to receive a wireless signal;

(iv) an expansion mechanism;

wherein the movement mechanism causes the expansion mechanism to activate which expands the packer and so moving the packer from said first position to said second position in response to a change in the signal being received by the wireless receiver;

(b) sensors to detect pressure in the well, in the vicinity of the safety mechanism;

wherein a sensor is provided above and a sensor is provided below the safety mechanism to monitor differential pressure across the valve;

wherein in use, in the event of an emergency situation, a wireless signal is sent into the well to the safety mechanism.

36. A well as claimed in claim 35, wherein the safety mechanism comprises a battery.

37. A well as claimed in claim 35, wherein the wireless receiver is an acoustic receiver and the signal is an acoustic signal.

38. A method of inhibiting fluid flow from a well as claimed in claim 35 in an emergency situation, the method comprising: in the event of an emergency situation, sending a wireless signal into the well to the safety mechanism.

39. A method as claimed in claim 38, wherein the signals are sent retroactively, after an emergency situation has occurred.

40. The well of claim 35, wherein the safety mechanism is adapted to actuate using well pressure acting against an atmospheric chamber.

41. A method of deploying the safety mechanism according to claim 35, the method comprising monitoring the well using data received from the sensors.

42. The method of claim 41, comprising monitoring the well using data received from the sensors whilst abandoning the well and/or cementing the well and/or suspending the well.

43. The method of claim 41, method comprising monitoring the well during at least one of:

cement tests;

testing pressures on either side of packers, sleeves, valves or obstructions;

and wellhead pressure tests.

44. The method of claim 41, wherein the method comprises monitoring the well when a BOP is in use.

45. The method of claim 44, wherein the method comprises monitoring the well during non-drilling phases when the BOP is in use.

46. The method of claim 41, wherein the method comprises drilling.

47. The method of claim 41, wherein the method comprises inhibiting fluid flow from the well in the emergency situation.

* * * * *